US007159653B2

(12) United States Patent
Vold

(10) Patent No.: US 7,159,653 B2
(45) Date of Patent: Jan. 9, 2007

(54) SPACER SUB

(75) Inventor: Gisle Vold, Sandnes (NO)

(73) Assignee: Weatherford/Lamb, Inc., Houston, TX (US)

( * ) Notice: Subject to any disclaimer, the term of this patent is extended or adjusted under 35 U.S.C. 154(b) by 221 days.

(21) Appl. No.: 10/375,614

(22) Filed: Feb. 27, 2003

(65) Prior Publication Data

US 2004/0168794 A1 Sep. 2, 2004

(51) Int. Cl.
*E21B 17/00* (2006.01)

(52) U.S. Cl. ..... 166/242.1; 138/114; 138/177

(58) Field of Classification Search ..... 166/65.1, 166/250.01, 242.1, 66; 138/113, 114, 177
See application file for complete search history.

(56) References Cited

U.S. PATENT DOCUMENTS

| | | | | |
|---|---|---|---|---|
| 3,673,785 | A * | 7/1972 | Cullen et al. | 242/441.2 |
| 3,858,653 | A * | 1/1975 | Turbyfill | 166/173 |
| 5,767,411 | A | 6/1998 | Maron | 73/705 |
| 5,844,667 | A | 12/1998 | Maron | 356/35.5 |
| 5,877,426 | A | 3/1999 | Hay et al. | 73/733 |
| 5,892,860 | A | 4/1999 | Maron et al. | 385/12 |
| 5,925,879 | A | 7/1999 | Hay | 250/227.14 |
| 5,945,665 | A | 8/1999 | Hay | 250/227.14 |
| 5,973,317 | A | 10/1999 | Hay | 250/227.14 |
| 5,986,749 | A | 11/1999 | Wu et al. | 356/73.1 |
| 5,987,197 | A | 11/1999 | Kersey | 385/24 |
| 6,009,216 | A | 12/1999 | Pruett et al. | 385/12 |
| 6,016,702 | A | 1/2000 | Maron | 73/705 |
| 6,072,567 | A | 6/2000 | Sapack | 356/32 |
| 6,082,455 | A | 7/2000 | Pringle et al. | 166/250.15 |
| 6,118,914 | A | 9/2000 | Davis et al. | 385/37 |
| 6,175,108 | B1 | 1/2001 | Jones et al. | 250/227.14 |
| 6,191,414 | B1 | 2/2001 | Ogle et al. | 250/227.14 |
| 6,227,114 | B1 | 5/2001 | Wu et al. | 102/201 |
| 6,229,827 | B1 | 5/2001 | Fernald et al. | 372/20 |
| 6,233,374 | B1 | 5/2001 | Ogle et al. | 385/13 |
| 6,239,363 | B1 * | 5/2001 | Wooters | 174/47 |
| 6,249,624 | B1 | 6/2001 | Putnam et al. | 385/37 |
| 6,252,656 | B1 | 6/2001 | Wu et al. | 356/73.1 |
| 6,268,911 | B1 | 7/2001 | Tubel et al. | 356/72 |
| 6,271,766 | B1 | 8/2001 | Didden et al. | 340/853.1 |
| 6,274,863 | B1 | 8/2001 | Kersey | 250/227.14 |
| 6,279,660 | B1 | 8/2001 | Hay | 166/336 |
| 6,298,184 | B1 | 10/2001 | Putnam et al. | 385/37 |
| 6,305,227 | B1 | 10/2001 | Wu et al. | 73/705 |

(Continued)

OTHER PUBLICATIONS

W. Furlow, "Intelligent Wells: Low-End and High-End Systems and How They Work—Where is the Technology Going?" Offshore Magazine, p. 96-110 (Apr. 2001).

(Continued)

*Primary Examiner*—David Bagnell
*Assistant Examiner*—Daniel P Stephenson
(74) *Attorney, Agent, or Firm*—Patterson & Sheridan, LLP

(57) ABSTRACT

The present invention involves a method and apparatus for communicating from within a wellbore to the surface of the wellbore, as well as communicating from the surface of the wellbore to downhole within the wellbore. More specifically, the present invention involves a method and apparatus for protecting and controlling cables or lines which connect surface equipment to downhole equipment. A spacer sub comprising a tubular body with a helical groove therearound is used to house one or more downhole cables. In one aspect, the spacer sub has a recess within the helical groove for housing one or more cable connectors. In another aspect, multiple helical grooves are disposed around the spacer sub to protect and house cables of different length.

10 Claims, 3 Drawing Sheets

U.S. PATENT DOCUMENTS

| | | | | |
|---|---|---|---|---|
| 6,310,990 | B1 | 10/2001 | Putnam et al. | 385/12 |
| 6,317,555 | B1 | 11/2001 | Maron et al. | 385/137 |
| 6,321,007 | B1 | 11/2001 | Sanders | 385/37 |
| 6,346,702 | B1 | 2/2002 | Davis et al. | 250/227.14 |
| 6,351,987 | B1 | 3/2002 | Winston et al. | 73/53.01 |
| 6,354,147 | B1 | 3/2002 | Gysling et al. | 73/61.79 |
| 6,363,089 | B1 | 3/2002 | Fernald et al. | 372/20 |
| 6,403,949 | B1 | 6/2002 | Davis et al. | 250/227.27 |
| 6,404,961 | B1 | 6/2002 | Bonja et al. | 385/109 |
| 6,439,055 | B1 | 8/2002 | Maron et al. | 73/705 |
| 6,443,226 | B1 | 9/2002 | Diener et al. | 166/241.6 |
| 6,445,868 | B1 | 9/2002 | Grunbeck et al. | 385/138 |
| 6,450,037 | B1 | 9/2002 | McGuinn et al. | 73/705 |
| 6,452,667 | B1 | 9/2002 | Fernald et al. | 356/73.1 |
| 6,453,108 | B1 | 9/2002 | Sirkis | 385/136 |
| 6,456,771 | B1 | 9/2002 | Sanders | 385/124 |
| 6,457,518 | B1 | 10/2002 | Castano-Mears et al. | |
| 6,457,521 | B1 | 10/2002 | Langseth et al. | 166/264 |
| 6,462,329 | B1 | 10/2002 | Davis et al. | 250/227.14 |
| 6,463,813 | B1 | 10/2002 | Gysling | 73/862.59 |
| 6,464,011 | B1 | 10/2002 | Tubel | 166/313 |
| 6,466,716 | B1 | 10/2002 | Ogle | 385/37 |
| 6,470,036 | B1 | 10/2002 | Bailey et al. | 372/20 |
| 6,474,152 | B1 | 11/2002 | Mullins et al. | 73/152.22 |
| 6,575,239 | B1 * | 6/2003 | Allen | 166/170 |
| 6,634,388 | B1 * | 10/2003 | Taylor et al. | 138/114 |
| 6,837,310 | B1 | 1/2005 | Martin | |
| 6,848,510 | B1 | 2/2005 | Bixenman et al. | |
| 6,863,131 | B1 | 3/2005 | Richard | |
| 2001/0042623 | A1 * | 11/2001 | Reynolds | 166/312 |
| 2003/0168221 | A1 * | 9/2003 | Zachman | 166/378 |
| 2003/0213598 | A1 * | 11/2003 | Hughes | 166/380 |
| 2004/0065437 | A1 * | 4/2004 | Bostick et al. | 166/250.01 |
| 2004/0154390 | A1 | 8/2004 | Baustad | |

OTHER PUBLICATIONS

Intelligent Well Completion: The Next Steps, W. Magazine, pp. 18-20 (Sep. 2002).

Intelligent Completions: Potential, But Some Hurdles, Drilling Contractor, pp. 40-42 (Mar./Apr. 2001).

* cited by examiner

SPACER SUB

BACKGROUND OF THE INVENTION

1. Field of the Invention

The present invention relates generally to oilfield operations. More particularly, the present invention pertains to apparatus and methods for monitoring downhole conditions in hydrocarbon wellbores, including fluid characteristics and formation parameters, using fiber optic gauges and other instrumentation. Moreover, the present invention pertains to apparatus and methods for controlling downhole equipment or instrumentation from the surface of the wellbore.

2. Description of the Related Art

In the drilling of oil and gas wells, a wellbore is formed using a drill bit that is urged downwardly at a lower end of a drill string. When the well is drilled to a first designated depth, a first string of casing is run into the wellbore. The first string of casing is hung from the surface, and then cement is circulated into the annulus behind the casing. Typically, the well is drilled to a second designated depth after the first string of casing is set in the wellbore. A second string of casing, or liner, is run into the wellbore to the second designated depth. This process may be repeated with additional liner strings until the well has been drilled to total depth. In this manner, wells are typically formed with two or more strings of casing having an ever-decreasing diameter.

After a well has been drilled, it is desirable to provide a flow path for hydrocarbons from the surrounding formation into the newly formed wellbore. To accomplish this, perforations are shot through a wall of the liner string at a depth which equates to the anticipated depth of hydrocarbons. Alternatively, a liner having pre-formed slots may be run into the hole as the lowest joint or joints of casing. Alternatively still, a lower portion of the wellbore may remain uncased so that the formation and fluids residing therein remain exposed to the wellbore. Hydrocarbon production is accomplished when hydrocarbons flow from the surrounding formation, into the wellbore, and up to the surface.

In modern well completions, downhole tools or instruments are often employed. These downhole tools or instruments include, but are not limited to, sliding sleeves, submersible electrical pumps, downhole chokes, and various sensing devices. These devices are controlled from the surface via hydraulic control lines, electrical control lines, mechanical control lines, fiber optics, and/or a combination thereof. The cables or lines extend from the surface of the wellbore to connect surface equipment to the downhole tools or instruments.

Additionally, during the life of a producing hydrocarbon well, it is sometimes desirable to monitor conditions in situ. Recently, technology has enabled well operators to monitor conditions within a hydrocarbon wellbore by installing permanent monitoring equipment downhole. The monitoring equipment permits the operator to monitor downhole fluid flow, as well as pressure, temperature, and other downhole parameters. Downhole measurements of pressure, temperature, and fluid flow play an important role in managing oil and gas reservoirs.

Historically, permanent monitoring systems have used electronic components to provide real-time feedback as to downhole conditions, including pressure, temperature, flow rate, and water fraction. These monitoring systems employ temperature gauges, pressure gauges, acoustic sensors, and other instruments, or "sondes," disposed within the wellbore. Such instruments are either battery operated, or are powered by electrical cables or lines deployed from the surface.

Recently, fiber optic sensors have been developed. Fiber optic sensors communicate readings from the wellbore to optical signal processing equipment located at the surface. The fiber optic sensors may be variably located within the wellbore. For example, optical sensors may be positioned to be in fluid communication with the housing of a submersible electrical pump. Such an arrangement is taught in U.S. Pat. No. 5,892,860, issued to Maron, et al., in 1999. The '860 patent is incorporated herein in its entirety, by reference. Sensors may also be disposed along the production tubing within the wellbore. In either instance, a cable is run from the surface to the sensing apparatus downhole. The cable transmits optical signals to a signal-processing unit at the surface of the wellbore.

In order to connect downhole sensors with signal processing equipment at the surface, fiber optic and electrical cables and lines must be connected through downhole production equipment such as packers and/or annular safety valves. This downhole production equipment represents a barrier through which downhole cables must travel to reach the downhole equipment to which the cable is to be connected. To minimize time spent feeding cable through the barriers at the production site, segments of cable are often placed through these barriers prior to reaching the production site. Cable connectors are then placed on the segments of cable so that the segments may be connected at the production site to the cable run into the wellbore from the surface equipment.

When downhole cables are used to connect downhole equipment to surface equipment, the cables are typically wrapped around the working string to take up the slack in the length of the cable. The cables and cable connectors are thus left unprotected from the harsh and turbulent environment present in the wellbore. Consequently, fluid flow around the production string below the tubing-casing packer threatens the integrity of the cables and cable connectors. Of even greater concern is trauma inflicted on cables during initial run-in. In this respect, it is understood that many wellbores are drilled at deviated and highly deviated angles, meaning that cables external to the production string are subject to abrasion against the liner strings and any open hole wellbore portion. Wear and tear on the cables and cable connectors may force replacement of the cables or cable connectors, resulting in increased operating expense and lost production time.

Additional problems also arise from the placement of cable along production tubing. When fixed lengths of cable are used, the operator often attempts to space out the required length of cable along the existing length of the production string or other tubing disposed within the wellbore. This task is often impossible due to the different lengths of cable that are used in wellbore operations. In order to take up slack in the cable, the operator must wind the cable around the production string. In some instances, the operator must wrap the cable multiple times around the tubing to take up the slack, even crossing the cable over itself or with other cables. Crossing the cable is disadvantageous because the cable juts outward radially from the tubing, thus becoming more easily damaged due to increased exposure to the wellbore fluids over time and due to contact with the wellbore during run-in.

Thus, there is a need for an apparatus which protects ordinarily exposed cables and cable connectors from damage due to downhole conditions. There is a further need for an apparatus which allows cable to be wrapped in an orderly fashion around the tubing within the wellbore, thus controlling the location of the cable within the wellbore and preventing damage due to the crossing of cables and attempts to take up slack in a cable line.

SUMMARY OF THE INVENTION

Hereinafter, when the term "cables" is used, the term shall include electrical lines, hydraulic lines, data acquisition lines, communication lines, fiber optics, and mechanical lines. "Surface equipment" includes processing equipment such as signal processors and central processing units, as well as equipment used to operate downhole tools or instruments. "Downhole equipment" includes downhole production tools or instruments such as sliding sleeves, submersible electrical pumps, and downhole chokes, as well as downhole monitoring equipment such as sensing devices and control instrumentation.

The present invention generally provides a downhole spacer sub for housing and protecting cables, which connect downhole equipment to surface equipment. The spacer sub is configured to be threadedly connected to a working string, such as a string of production tubing or an injection tubing. The spacer sub has a tubular-shaped body with a bore therethrough. The wall of the spacer sub is preferably thicker than the wall of the working string so that the outer diameter of the spacer sub is larger than the outer diameter of the working string. The larger outer diameter of the spacer sub relative to the working string allows the spacer sub to serve as a flow coupling.

The spacer sub of the present invention comprises at least one cable groove formed in the outer diameter of the spacer sub. The cable groove defines a spiral recess along the outer surface of the spacer sub. A cable is directed through the cable groove so that the cable wraps around the spacer sub. Optional countersunk keeper plates hold the cable in place within the cable groove. The spacer sub may have multiple cable grooves for housing multiple lengths of cable and multiple keeper plates along each of the cable grooves. Also, the spacer sub may further comprise at least one connector groove, which is larger than the cable groove to house and protect any cable connectors, which connect portions of the cable.

The spacer sub of the present invention is advantageous because the cable groove allows the length of the cable to spiral around the outside of the spacer sub, thus taking up any slack in the length of the cable. When multiple cable grooves of various spiral angles around the spacer sub are formed to receive various lengths of cable, cables of different lengths can be wrapped around the spacer sub within the cable grooves. Housing the cable within the cable groove takes up the slack in the cable length without damaging the cable. Moreover, housing the cable within the cable groove protects the cable from suffering damage during tubing run-in, and due to fluid flow outside the spacer sub during wellbore operations. In this respect, the cable is flush with the spacer sub and protected from turbulent fluid flow. Furthermore, when multiple cables used to connect multiple downhole devices to the surface are placed within the cable groove, the cables are positioned within the cable grooves in an orderly fashion. The orderly manner in which the cables are positioned within the cable grooves minimizes damage to the cables due to the exposure to damaging fluid caused by the crossing of multiple cables and the increased outer diameter of the spacer sub due to this crossing of the cables.

A further advantage of the present invention is that the cable connector groove on the spacer sub protects the cable connector from trauma during run-in and from erosion due to fluid flow in wellbore operations. Additionally, the spacer sub can serve as a flow coupling when used in conjunction with annular safety valves and packers, so that the additional wall thickness of the spacer sub prevents failures due to erosion in areas of turbulent fluid flow. Most advantageously, the spacer sub of the present invention performs the three desired functions of flow coupling, protecting downhole cables, and wrapping downhole cables all at once.

BRIEF DESCRIPTION OF THE DRAWINGS

So that the manner in which the above recited features of the present invention can be understood in detail, a more particular description of the invention, briefly summarized above, may be had by reference in the appended drawings. It is to be noted, however, that the appended drawings illustrate only typical embodiments of this invention and are therefore not to be considered limiting of its scope.

DETAILED DESCRIPTION OF THE PREFERRED EMBODIMENT

Figure 1:
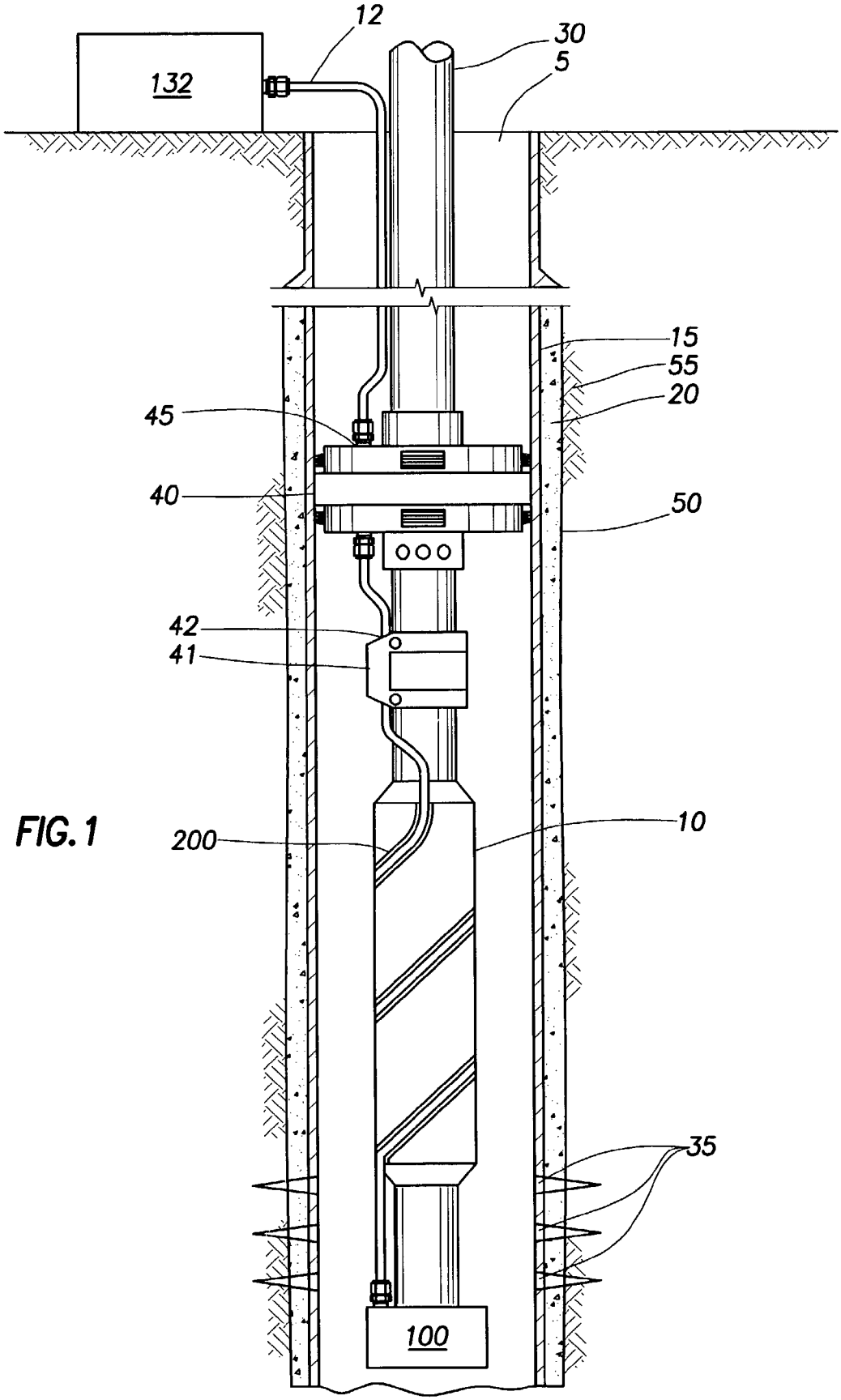
FIG. 1 presents a cross-sectional view of one embodiment of the spacer sub of the present invention. The spacer sub is disposed in a wellbore, and has a cable housed therein to connect downhole equipment to equipment at the surface.

FIG. 1 presents a cross-sectional view of a wellbore 50, which has been completed for the production of hydrocarbons. The wellbore 50 extends downward into a formation 55, sometimes referred to in the industry as the pay zone, the area of interest, or the production depth. The wellbore 50 has a string of casing 15 disposed therein. The casing 15 has been cemented into place along the formation 55 by a column of cement 20. The casing 15 is a tubular-shaped body with a bore therethrough. The lower end of the casing 15 is perforated. Perforations 35 provide fluid communication between the formation 55 and the internal bore of the casing 15. It is understood, however, that the present invention may also be used in an open hole wellbore or any other type of completion.

A working string 30, which is hung from a surface production assembly (not shown), is disposed within the casing 15 and extends from the surface of the wellbore 50 to the production depth. The working string 30 defines an elongated tubular body having a bore therethrough. A packer 40 is seen disposed around the outer diameter of the working string 30 to seal off an annular space 5 between the casing 15 and the working string 30. Production fluids, which enter the wellbore 50 through the perforations 35, are forced by the packer 40 upward through the working string 30 and to the surface of the wellbore 50. While wellbore 50 is presented as a producing well having string 30 as a production tubing, it is understood that the wellbore 50 may be an injection well, and working string 30 may be an injection string.

A spacer sub 10 is located within the wellbore 50. In the arrangement of FIG. 1, the spacer sub 10 is threadedly connected to the working string 30 below the packer 40. The spacer sub 10 is a tubular-shaped body with a bore therethrough which is preferably 6 to 10 feet in length. The spacer sub 10 preferably has thicker walls than the working string 30 and therefore has a larger outer diameter than the working string 30. The thick-walled spacer sub 10 can serve as a flow coupling to prevent failures caused by erosion of various completion components such as landing nipples (not shown) in turbulent fluid flow areas in the annular space 5. When used as a flow coupling, the spacer sub 10 preferably is constructed with 2⅞-inch to 7-inch tubing.

Also seen in the wellbore 50 of FIG. 1 is an item of downhole equipment. The downhole equipment is shown schematically at 100, located below the spacer sub 10. The downhole equipment 100 is utilized to monitor conditions downhole, including but not limited to pressure, temperature, acoustics, and flow rate of hydrocarbons. In the alternative, the downhole equipment 100 may include downhole production equipment or instruments. The downhole equipment 100 may include one or more sensors which may define pressure gauges, temperature gauges, acoustic sensors, or other sondes. In one aspect of the present invention, the downhole equipment 100 is designed to operate through one or more fiber optic sensors.

The downhole equipment 100 is connected to the lower end of a cable 12. The cable 12 ultimately connects at its upper end to surface equipment 132 located at the surface of the wellbore 50. In one aspect, the cable 12 sends information collected by the downhole equipment 100 to the surface equipment 132. The surface equipment 132 may include signal processing equipment such as a central processing unit which analyzes the information gathered from the downhole equipment 100. The surface equipment 132 may also send signals such as excitation light to the downhole equipment 100. Moreover, the surface equipment 132 may send signals to operate downhole production equipment or instruments.

Preferably, the cable 12 is designed to withstand high temperatures and pressures within the wellbore 50. The cable 12 includes but is not limited to a fiber optic cable, hydraulic cable, or electrical cable. When the cable 12 is a fiber optic cable, it includes an internal optical fiber which is protected from mechanical and environmental damage by a surrounding capillary tube. The capillary tube is made of high strength, rigid walled, corrosion-resistant material, such as stainless steel. The tube is attached to the downhole equipment 100 by appropriate means, such as threads, a weld, or other suitable method. The optical fiber contains a light guiding core which guides light along the fiber. The core preferably includes one or more sensor elements such as Bragg gratings to act as a resonant cavity, and to also interact with the downhole equipment 100.

In the arrangement of FIG. 1, the cable 12 is run from the surface equipment 132 downward, and then through a port 45 located within the packer 40. From there, the cable 12 runs through a port 42 located within an annular safety valve 41. The cable 12 then reaches the spacer sub 10 below the packer 40. When the cable 12 reaches the spacer sub 10, the cable 12 is run through a cable groove 200 located along the outer diameter of the spacer sub 10. The cable groove 200 defines a spiral-shaped recess or indentation in the spacer sub 10 disposed around the outer surface of the spacer sub 10. In the particular embodiment of FIG. 1, the cable 12 is housed within the cable groove 200 to helically surround the spacer sub 10. The length of the cable groove 200 is calculated to house an anticipated surplus length of cable 12.

Figure 2:
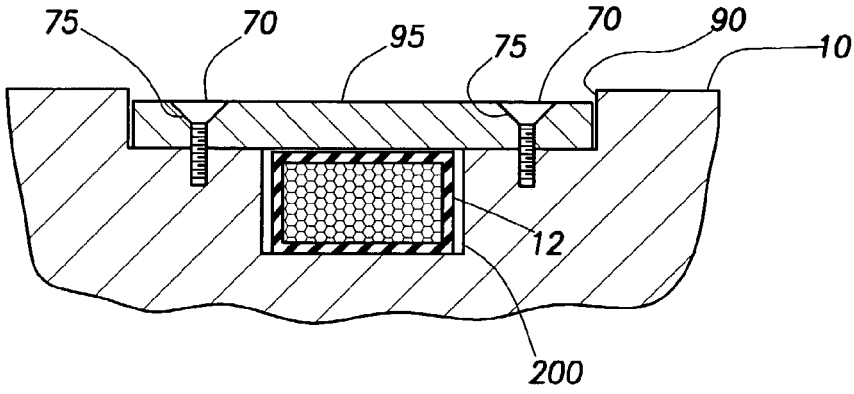
FIG. 2 provides a sectional side view of a groove on the spacer sub of FIG. 1. In this view, the spacer sub has a countersunk keeper plate located within the groove.

FIG. 2 shows a cross-sectional side view of a portion of the spacer sub 10. Visible in this view is a cable groove 200 disposed in the sub 10. The cable groove 200 is shaped deep and wide enough to substantially house the cable 12. The cable groove 200 is preferably wide enough to accommodate various different cables used in the production of hydrocarbons as well as to house multiple cables at the same time. Located above the cable groove 200 in the view of FIG. 2, and radially outward from the cable groove 200 in the view of FIG. 1, is a keeper plate groove 90. The keeper plate groove 90 is dimensioned to be wider than the cable groove 200 so that a keeper plate 95 or other retaining member maintains the cable 12 in place along the cable groove 200. The keeper plate groove 90 is shaped deep and wide enough to accommodate the keeper plate 95.

Figure 3:
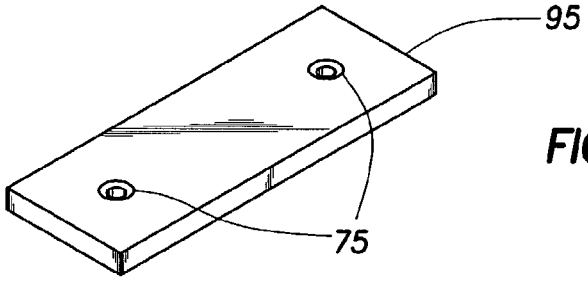
FIG. 3 is a perspective of the countersunk keeper plate of FIG. 2.

A perspective view of the keeper plate 95 is shown in FIG. 3. The keeper plate 95 may be rectangular in shape, as shown in FIG. 3, or any other shape which will perform the purpose of holding the cable 12 in place within the cable groove 200. The keeper plate 95 is preferably 2 mm to 3 mm thick and may have defined or rounded edges. The keeper plate 95 preferably has two holes 75 therethrough for receiving screws 70, as shown in FIG. 2. Although two screws 70 are illustrated in FIGS. 2 and 3, any number or type of fasteners 70 may be utilized with the present invention. Referring again to FIG. 2, the screws 70 are placed through the holes 75 in the keeper plate 95 and through a portion of the spacer sub 10 so that the keeper plate 95 is secured to the spacer sub 10 and housed in the keeper plate groove 90.

As seen in FIG. 2, the keeper plate 95 is countersunk into the spacer sub 10 so that even the outermost portion of the keeper plate 95 is located within the outer diameter of the spacer sub 10. Countersinking the keeper plate 95 prevents the interruption of fluid flow within the wellbore 50. In this respect, if the keeper plate 95 protrudes radially outward past the outer diameter of the spacer sub 10, unwanted turbulence could be created as fluid flows over the keeper plate 95. Numerous keeper plates 95 may be disposed within the keeper plate groove 90. The keeper plates 95 are placed within the keeper plate grove 90 at intervals needed to prevent the cable 12 from protruding out of the cable groove 200.

Figure 4:
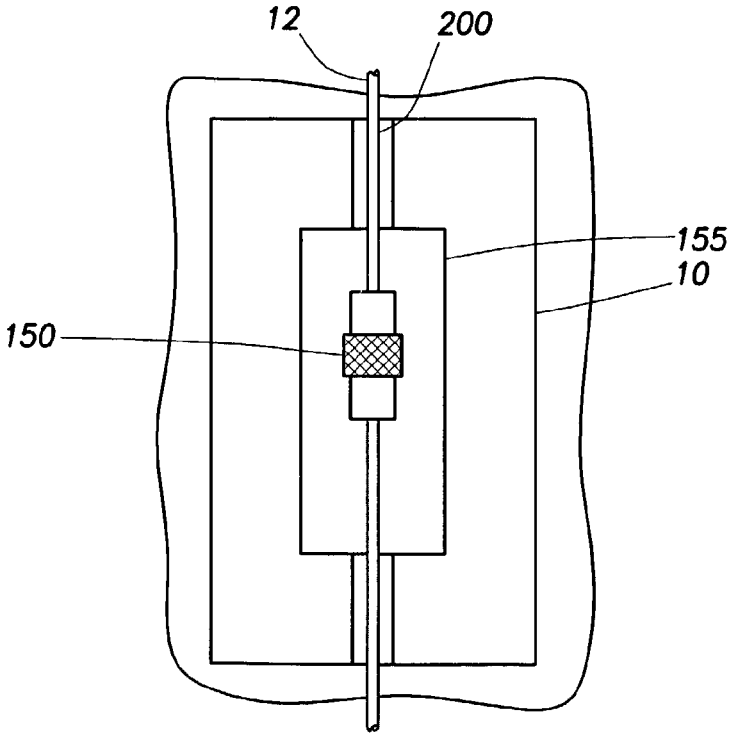
FIG. 4 shows a sectional view of a housing for a cable connector for use with the spacer sub of FIG. 1.

Optionally, a cable connector 150 may be protected at the top of the spacer sub 10 as shown in FIG. 4. The cable connector 150 is used to connect portions of the cable 12 to one another, and is especially useful when the spacer sub 10 is used in conjunction with the packer 40 and the annular safety valve 41. An exemplary cable connector 150 is a dry mate connector used with fiber optics. The cable connector 150 is ordinarily approximately 0.9 inches thick. A connector groove 155 may be formed in the spacer sub 10 to house the cable connector 150 securely, thus protecting the cable connector 150 from damage caused by fluid flow through the annular space 5 and further preventing interruption of fluid flow by a protruding cable connector. The connector groove 155 defines a recess in the sub 10 which is preferably wider than the cable groove 200 and impressed deeper into the spacer sub 10 than the cable groove 200 so as to accommodate the larger diameter of the cable connector 150 relative to the cable 12. The connector groove 155 is designed to essentially conform to the outer diameter of the cable connector 150, so that the cable connector 150 is closely held within the spacer sub 10. While only one connector groove 155 is shown in FIG. 4, multiple connector grooves 155 may be provided along the spacer sub 10 to house multiple cable connectors 150 along the cable 12, as needed.

Figure 5:
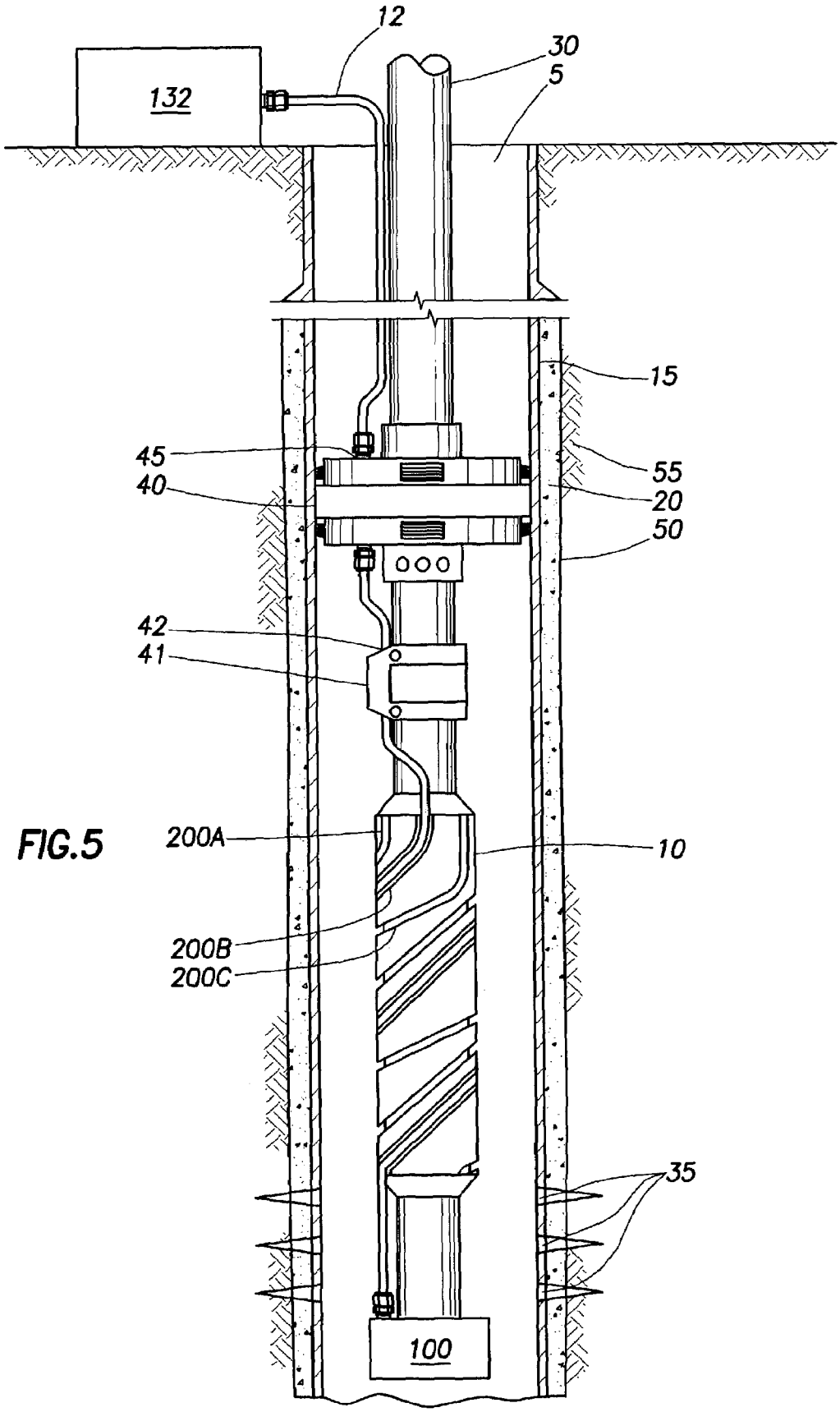
FIG. 5 presents a cross-sectional view of an alternate embodiment of the spacer sub of the present invention. The spacer sub is again disposed in a wellbore, and has a cable residing therein to connect downhole equipment to equipment at the surface.

An alternate embodiment of the spacer sub 10 of the present invention is shown in FIG. 5. The parts which are the same as in FIGS. 1–4 are labeled with the same numbers. The difference in this embodiment lies in the spacer sub 10. The spacer sub 10 has three cable grooves 200A, 200B, and 200C. The cable grooves 200A, 200B, and 200C are spiral grooves within the spacer sub 10 which are placed at different helical angles along the spacer sub 10 to house various lengths of cable 12. The spacer sub 10 may either have multiple entries for the cable 12 which are different for each cable groove 200A, 200B, or 200C, or one entry point may be utilized into the spacer sub 10. From there, the cable grooves 200A, 200B, and 200C may branch from the one entry point to house varying lengths of cable 12 along three different routes. The cable grooves 200A, 200B, and 200C allow for different lengths of cable 12 to be safely housed within the spiral grooves, and allows for slack in cables 12 of different lengths to be taken up. Furthermore, more than one cable 12 may be housed within the different cable grooves 200A, 200B, and 200C at the same time. When using multiple entry points for different lengths of cable, the entry points may be marked to designate the length of cable 12 the cable groove 200A, 200B, or 200C has the ability to accommodate, for example, different designations for 2-foot cable, 3-foot cable, and 4-foot cable.

Although FIG. 5 shows three different cable grooves 200A, 200B, and 200C, any number of cable grooves 200 can be used with the present invention. Any number of keeper plates (shown in FIG. 3) as described above may be utilized in each cable groove 200A, 200B, and 200C in the embodiment shown in FIG. 5. Furthermore, one or more cable connectors (shown in FIG. 4) may be protected in any number of connector grooves (not shown), in the embodiment of FIG. 5.

While the foregoing is directed to embodiments of the present invention, other and further embodiments of the invention may be devised without departing from the basic scope thereof, and the scope thereof is determined by the claims that follow.

The invention claimed is:

1. A downhole spacer sub connectible to a working string, the sub comprising:

a tubular body having a wall defining an inner surface and outer surface, a helical groove disposed around the outer surface of the wall, wherein the helical groove is designed to receive at least one cable, and at least one retaining member along the helical groove, wherein the at least one retaining member secures the at least one cable within the helical groove, wherein the at least one retaining member defines a keeper plate that is countersunk within the helical groove.

2. The spacer sub of claim 1, wherein the at least one retaining member is secured within the helical groove by one or more screws.

3. The spacer sub of claim 1, wherein multiple retaining members are disposed along the helical groove at intervals.

4. The spacer sub of claim 1, wherein the helical groove is dimensioned to receive more than one cable.

5. A downhole spacer sub connectible to a working string, the sub comprising:

a tubular body comprising a wall having an inner surface and outer surface, at least two grooves disposed within the outer surface of the wall and helically around the tubular body, wherein each of the grooves is designed to receive at least one cable, and wherein each of the grooves is dimensioned to receive a cable of different length.

6. The spacer sub of claim 5, further comprising at least one entry point for the at least one cable disposed at the bottom of each of the grooves.

7. The spacer sub of claim 5, further comprising an entry point for the at least one cable disposed at the bottom of the spacer sub, wherein the grooves branch from the entry point for receiving more than one cable.

8. The spacer sub of claim 5, wherein each groove is disposed within the outer surface of the wall to form a different path helically around the tubular body.

9. An apparatus for communicating information between a surface of a wellbore and within the wellbore, comprising:

a monitoring device disposed within the wellbore;

a processing device located at the surface of the wellbore;

a cable connecting the monitoring device and the processing device; and a tubular body which absorbs a length of the cable within a helical groove disposed around the tubular body, wherein keeper plates spaced intermittently along the helical groove retain a length of the cable within the helical groove.

10. The apparatus of claim 9, wherein the helical groove is further recessed at intervals to substantially house a connecting device within the tubular body.

* * * * *